United States Patent [19]

Yasuzuka et al.

[11] 3,967,441

[45] July 6, 1976

[54] YARNS AND PROCESS FOR PRODUCTION THEREOF

[75] Inventors: Katsumi Yasuzuka, Uji; Takaaki Matsuo, Kyoto; Hachiro Fujiwara, Uji, all of Japan

[73] Assignee: Unitika Ltd., Amagasaki, Japan

[22] Filed: Apr. 29, 1974

[21] Appl. No.: 464,878

[30] Foreign Application Priority Data

Apr. 28, 1973 Japan ..... 48-48200

[52] U.S. Cl. ..... 57/140 J; 57/2; 57/157 R; 57/157 TS; 57/157 S

[51] Int. Cl.[2] ..... D02G 3/00; D02G 1/00; D01G 1/06; D01H 5/30

[58] Field of Search ..... 57/2, 34 R, 36, 51, 57/140 J, 157 R, 157 TS, 157 MS, 157 F, 157 S, 34 HS

[56] References Cited

UNITED STATES PATENTS

| | | | |
|---|---|---|---|
| 2,092,800 | 9/1937 | Dickie et al. | 57/157 S |
| 2,432,355 | 12/1947 | Truitt | 57/157 S X |
| 2,523,854 | 9/1950 | Woods | 57/2 X |
| 2,810,281 | 10/1957 | Appleton et al. | 57/157 S UX |
| 3,298,169 | 1/1967 | Comer | 57/157 TS |
| 3,444,682 | 5/1969 | Polacco et al. | 57/140 J |
| 3,708,970 | 1/1973 | MacFarlane | 57/157 S X |
| 3,745,757 | 7/1973 | Selwood | 57/157 R |

*Primary Examiner*—Donald E. Watkins
*Attorney, Agent, or Firm*—Sughrue, Rothwell, Mion, Zinn & Macpeak

[57] ABSTRACT

A yarn comprising thermoplastic synthetic staple fibers or thermoplastic synthetic staple fibers and continuous filaments, in which the individual fibers constituting the yarn contain twisted crimps and having cross-sectional surfaces with a markedly flattened portion, in which the staple fibers contained therein have broken ends comprising mainly portions flattened to a lesser degree, a plurality of fibers having this structure uniformly and alternately forming the surface and inner layers of the yarn and being intertwined in a truly twisted state or in a substantially non-twisted state at fluffs formed of the broken ends of the individual fibers, and a process for producing a yarn which comprises drawing an undrawn yarn comprising multifilaments of a thermoplastic synthetic polymer and having substantially the same break elongation, in a twisted state at an elevated temperature thereby to remarkably flatten portions of the individual filaments which appear on the outer layer of the yarn, and immediately detwisting the yarn to break a part or all of those portions of the filaments which are flattened to a lesser degree, followed by taking up the yarn.

45 Claims, 13 Drawing Figures

FIG.4
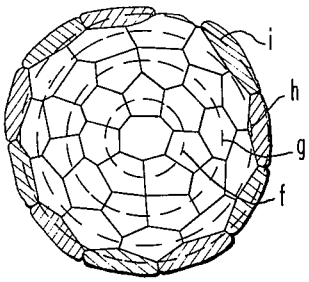
FIG.5
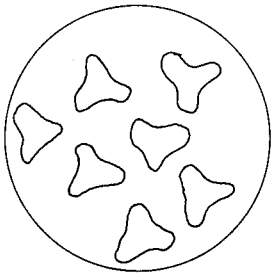
FIG.6
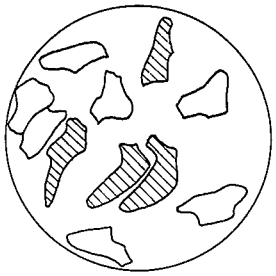
FIG.7
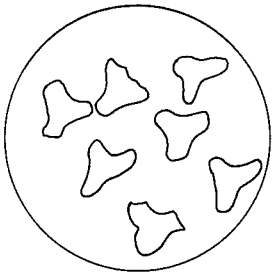
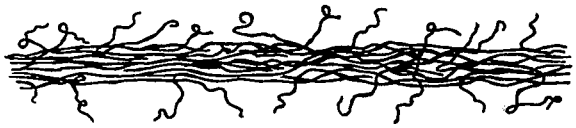
FIG.13
FIG.12
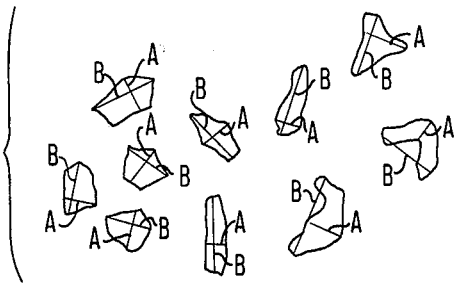

YARNS AND PROCESS FOR PRODUCTION THEREOF

BACKGROUND OF THE INVENTION

1. FIELD OF THE INVENTION

This invention relates to a yarn of thermoplastic synthetic fibers which resembles a spun yarn. In particular, the invention relates to a novel spinning process, and more specifically, to a process for producing a spun yarn-like yarn (sometimes to be referred to hereinafter simply as a "spun-like yarn") from insufficiently oriented fibers of a thermoplastic polymer directly in a substantially single step.

2. DESCRIPTION OF THE PRIOR ART

Processes for obtaining spun yarns from synthetic fibers are roughly classified into a group of processes using broken fibers, that is staple fibers, and another group of processes using filament yarns such as tows. The former group includes, for example, cotton, worsted, and silk spinning methods. A suitable spinning process is chosen depending on the length of the staple fibers used and the end use of the spun yarn, and when spinning synthetic fibers, the number of the steps is reduced or the time required for a particular step is shortened, as compared with the case of using natural fibers such as cotton or wool. Since the staple fibers used in these processes are in a compressed bale form and the directions of the individual fibers are quite at random, the spinning process using the staple fibers first involves opening the staple fibers to orient them in the same direction and to form a sliver, drafting it repeatedly while aligning the individual fibers to increase the directionality and uniformity of the fibers, and finally twisting the drafted sliver thereby to impart the tenacity required of a yarn due to the frictional force between the individual staple fibers and thus to form a spun yarn. This means that the spun yarn is obtained after going through several intermittent steps. Furthermore, the several steps in this process involve a different amount of products, so that very complicated equipment is required in order to combine these steps into a single continuous spinning process. Sufficient measures should also be taken to cope with any difficulties that may occur in each of the steps and to control and maintain the apparatus.

The latter group of spinning processes using filament yarns is divided into a staple method (the Perlok system, the Turbo Stapler system, or the direct spinning system) which comprises drafting a tow of drawn fibers further between draft rolls and breaking the tow to form continuous slivers, and a converter method which comprises obliquely breaking a tow of fibers spread and paralleled, and then intertwining the broken tows into a continuous sliver. Except for the direct spinning system, in such a process also, the tows are first converted to slivers, and a spun yarn is produced through several drafting steps. In the latter half of the process, the same steps as used in the spinning process using staple fibers must be performed. In the direct spinning system, no new step is required after drafting and breaking the filaments to form slivers. However, the unevenness in the slivers formed due to a slight unevenness in tenacity and elongation of the tow and the unevenness in the fiber length arising from the tow are further promoted at the time of drafting, and therefore, in order to obtain uniform yarns, the tow must have a considerably high quality level.

In contrast to these conventional spinning processes, the present invention involves a simplification and improvements of efficiency of the entire spinning process.

SUMMARY OF THE INVENTION

Accordingly, an object of this invention is to provide a yarn resembling spun yarn directly from a thermoplastic polymer which is not sufficiently oriented.

Another object of this invention is to provide a spinning process whereby a multifilament yarn of a thermoplastic polymer which is insufficiently molecularly oriented is drawn in the strongly twisted state at an elevated temperature thereby to flatten in the twisted state the individual filaments which constitute the yarn while the filaments migrate through the inner and outer layers of the yarn, and the filaments which are exposed to the outer layer and are flattened to a lesser degree are broken to staple fibers.

Still another object of this invention is to provide a loosely twisted or substantially non-twisted yarn having a superior feel.

The yarn of this invention comprises thermoplastic synthetic staple fibers or thermoplastic snythetic staple fibers and continuous filaments, the individual fibers which constitute the yarn containing twisted crimps and having cross-sectional surfaces with a markedly flattened portion, the staple fibers contained therein having broken ends mainly of portions flattened to a lesser degree, a plurality of fibers having this structure uniformly and alternately forming the surface and inner layers of the yarn and being intertwined in a truly twisted state or in a substantially non-twisted state at fluff formed of the broken ends of the individual fibers.

BRIEF DESCRIPTION OF THE ACCOMPANYING DRAWINGS

FIGS. 1 and 2 each show an embodiment of the apparatus which is used in this invention.

FIG. 4 shows a cross-section of a yarn when a yarn comprising an undrawn yarn having circular cross-section is simultaneously drawn and false-twisted.

FIG. 5 shows a cross-sectional surface of an ordinary drawn yarn having a typical non-circular cross section.

FIG. 6 shows a cross-sectional surface of an undrawn yarn treated by the process of this invention.

FIG. 7 shows a cross-sectional surface of an undrawn yarn treated by a conventional method.

FIG. 12 shows the degree of flatness of the filaments.

FIG. 13 shows a side view of the yarn of this invention.

DETAILED DESCRIPTION OF THE INVENTION

Figure 1:
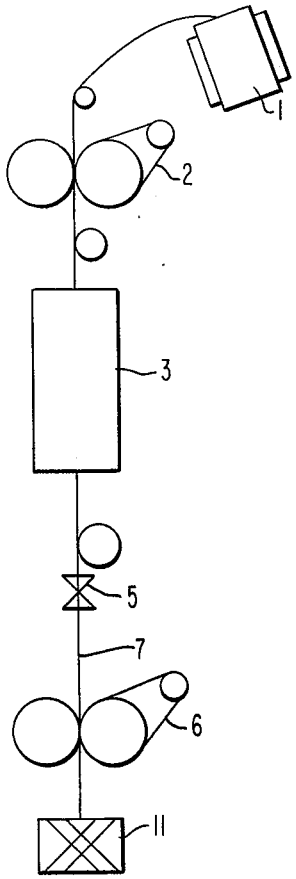

Because of the above-described structure, the yarn of this invention has an appearance similar to that of a spun yarn having fine fluffs. When used as such, the yarn constitutes a novel yarn having a superior feel and appearance, which has high bulkiness as a result of the yarn being loosely twisted, and also stretchability due to the crimps of the fibers.

The present invention pertains primarily to the yarn described above, a process for production thereof, and will be described below in greater detail.

Specifically, the present invention relates to a yarn obtained by feeding insufficiently oriented thermoplastic synthetic fibers from feed rollers to a heating device and a false twisting device to subject the fibers to a series of steps of heating, twisting and detwisting, and simultaneously drawing the fibers by draw rolls to flatten the cross-section of the individual fibers, and also simultaneously breaking a part or all of the synthetic fibers at the lesser flattened portions to staple fibers; and to a process for producing the yarn. The invention also pertains to a process for producing a yarn having good coherency by subjecting the resulting yarn to false twisting or true twisting or to other treatments.

According to this invention, a tow of drawn yarns or staples formed by breaking the tow are not used as in the production of conventional spun yarns, but a spun-like yarn can be directly prepared from an undrawn yarn in a single continuous process. Furthermore, in collecting the twisted yarns in this single process, the efficiency of production is high because a false twisting system is employed, and any desired method of winding can be selected.

The converting of undrawn yarns into staple fibers in the present invention is performed while the individual filaments of the yarns are being flattened by drawing in the false-twisted state at an elevated temperature. Accordingly, the drawing, crimping, processing and breaking of the yarns are performed most effectively.

An important characteristic feature of this invention resides in the use of an undrawn yarn of multifilaments having substantially the same break elongation, suitably ranging from about 120 to 400%. In order to obtain a fine spun-like yarn directly from a continuous yarn by such a method as drafting and breaking, use of a plurality of yarns having different properties usually has been regarded as essential, and it has been thought that when a yarn of multifilaments of the same properties is used, all the filaments would be broken at the time of converting them into staple fibers and a continuous yarn would not be able to be obtained.

Surprisingly, however, the present invention makes it possible to obtain a spun-like yarn directly from an undrawn yarn of multifilaments having the same break elongation. This yarn has sufficient tenacity for use in making woven or knitted fabrics, and the fluffiness of its surface quite resembles that of a spun yarn. Since the fibers of this yarn can be those having the same properties, the resulting yarn is uniform not only in appearance, the fluffiness and physical properties, but also in dyeability.

The use of filaments having the same break elongation also brings about great advantages not only in productivity and workability but also in the properties of the resulting yarn, and production control is best with such a yarn.

So long as the constituent filaments have the same break elongation, the undrawn yarn used in this invention can also be a ply yarn or twisted yarn of a multiplicity of filaments having different physical properties other than break elongation, different types of constituent fibers, and different colors, etc., or composite filaments each derived from two or more different polymers.

The mechanism whereby the continuous filaments are broken into staple fibers in the present invention is not entirely clear, but it is assumed that this breaking occurs mainly in a detwisting zone. It is presumed that the moment a yarn drawn in a twisting zone passes a detwisting point, a difference in stress occurs between the filaments in the inner layer of the yarn and the filaments in its outer layer, and a great force is exerted on the filaments which constitute the inner layer of the yarn. In other words, it is presumed that in the yarn which is simultaneously subjected to twisting and drawing, the filaments constituting the outer layer of the yarn are in a helical form, and therefore, the yarn is being drawn with the lengths of the individual filaments being different between the inner layer and the outer layer, and that consequently, a loosening of the outer layer in comparison with the inner layer occurs at the time of detwisting, and the tension on the yarn is exerted mainly on the filaments of the inner layer which are not helical in shape. Thus, it could be concluded that the filaments which constitute the inner layer of the yarn and which are flattened to a lesser degree are broken in the vicinity of the detwisting point at which the shear force arising from the detwisting and the pulling tension in the running direction of the yarn are exerted in combination.

The flattening of the sectional areas of the filaments, as referred to in the present specification and the appended claims, means that the sectional areas are flattened as shown in FIG. 12 so that the ratio of the short diameter (A) to the long diameter (B) ranges from about 1:2 to about 1:7. This ratio at the sectional areas of the broken ends of the fibers is from about 1:1 to about 1:2.

In the false twisting of an ordinary drawn yarn, the formation of staple fibers at detwisting is not sufficiently done, presumably because the individual constituent filaments already have sufficient tenacity required of a yarn and the lengths of the individual filaments are equal as a result of having been drawn substantially in a parallel condition. Accordingly, the use of a drawn yarn may provide a filamentary textured yarn having many fluff defects, but cannot provide a yarn which looks like a spun yarn.

Thus, in using the undrawn yarn in accordance with this invention, the number of fluffs becomes greater when the broken draw ratio of the yarn is higher, and the twisting angle of the filaments of the outer layer of the yarn against the yarn axis is greater (that is, there is a greater difference in length between the filaments in the outer layer and the filaments in the inner layer as a result of twisting). When a drawn yarn is used as in the conventional tow spinning process, and only drafting is performed without applying a simultaneous strong twisting, the optimum range of the draft ratio is very narrow, and even a slight non-uniformity in the properties of the drawn yarn results in drastic draft unevenness. This makes it impossible to obtain a normal yarn especially in a direct spinning system without a drawing process.

The term "undrawn yarn of synthetic fibers not sufficiently oriented " or "undrawn yarn of insufficiently oriented synthetic fibers", as used in the present specification and the appended claims denotes a yarn of various synthetic fibers, such as polyester, polyamide or polyacrylonitrile fibers, which need to be further drawn partially or completely to increase their degree of molecular orientation or crystallinity so that the yarn can be used as an ordinary yarn, and which has a residual drawability of at least about 80%, preferably at least 120% up to 400%.

If the residual drawability is less than the specified value, the flattening of the sectional area of the filaments in the twisting step is to a small degree, and the difference in length between the filaments in the outer layer and the filaments in the inner layer is less so that breaking of the filaments in the detwisting zone is difficult, thus making it impossible to obtain a satisfactory yarn. In order to obtain such undrawn yarns, the polyester filaments should preferably have a birefringence of not more than about $90 \times 10^{-3}$, preferably $5 \times 10^{-3}$ to $40 \times 10^{-3}$, especially preferably $5 \times 10^{-3}$ to $20 \times 10^{-3}$, and should be wound up at a high speed at a spinning speed of not more than about 4,500 m/min. In the case of polyamide filaments, it is preferred that the filaments have a birefringence of not more than about $60 \times 10^{-3}$, preferably $20 \times 10^{-3}$ to $40 \times 10^{-3}$, especially preferably $20 \times 10^{-3}$ to $29 \times 10^{-3}$, and be wound up at high speed at a spinning speed of not more that about 3,500 to 4,000 m/min. Further, in the case of polyether ester filaments, it is preferred that the filaments have a birefringence of not more than about $80 \times 10^{-3}$, preferably $2 \times 10^{-3}$ to $35 \times 10^{-3}$, especially preferably $2 \times 10^{-3}$ to $18 \times 10^{-3}$. Other synthetic fibers can also be used if the residual drawability of the undrawn yarn is at least about 80%.

The greater the residual drawability of the yarn is, the larger is the degree of falttening of the filaments, and the greater are the case and frequency with which the filaments are broken to staple fibers. However, undrawn yarns can be more easily handled when they have a smaller residual drawability and have an internal fibrous structure closer to that of ordinary drawn yarns. In actual operation, therefore, these factors should be considered together.

Suitable polymers which can be used in this invention are, for example, polyesters having an intrinsic viscosity ranging from about 0.4 to 1.3, preferably 0.4 to 0.8, and polyether esters having an intrinsic viscosity ranging from about 0.5 to 0.7, both measured at 20°C in a 1:1 by weight mixed solvent of phenol and tetrachloroethane, and polyamides having an intrinsic viscosity ranging from about 0.9 to 2.1, preferably 0.9 to 1.1, as measured at 30°C in 96% by weight sulfuric acid. In addition, in this invention, preferably the filaments used are of polymers having a lower intrinsic viscosity. The product thus obtained has many fluffs and antipilling characteristics. Preferred intrinsic viscosities are less than 0.69 for polyester and polyether ester fibers and less than 0.98 for polyamide fibers.

The treating conditions used in this invention, such as the heating temperature, the number of twists, the draw ratio, or the distance between the draw rolls can be determined as desired according to the structure and properties of the filaments used, the speed of treating the filaments, and the quality of the intended yarn.

The temperature can vary depending on the speed of treatment. Any fibers can be treated at a temperature of about 150° to 220°C if the heater length is sufficiently long and the treating time is about 0.1 to 0.5 sec. When the heater length is shorter and the treating time is shorter, the treatment can be performed at a temperature higher than about 300°C. More specifically, when polyester fibers are treated, the treating temperature generally is about 180° to 220°C and the treating time is about 0.1 to 0.5 second. Further, when polyether ester fibers are treated, the treating temperature generally is about 150° to 175°C and the treating time is about 0.1 to 0.5 second. Still further, in the case of the polyamide fibers, the polyamide fibers are generally treated at a temperature of from about 160° to 190°C for about 0.1 to 0.5 second. When polyamide fibers are used, better results can be obtained by preheating the fibers, or treating the fibers with water or a textile oil, prior to twisting and drawing.

A suitable draw ratio is about 0.8 to 1.0 times the maximum draw ration of the undrawn yarn used. The maximum draw ratio of the individual fibers cannot be unequivocably defined since it varies depending upon factors such as the spinning speed, kinds of fibers used, etc. Generally, the maximum draw ratio is about 1.20 to 3.70 for polyester fibers or polyether ester fibers, and about 1.10 to 3.00 for polyamide fibers. When it is desired to increase the number of fluffs, it is recommended to increase the draw ratio and decrease the length of the detwisting zone. When a smaller number of fluffs is desired, it is desirable to decrease the draw ratio and increase the length of the detwisting zone.

In the present invention, it is not necessary that all of the constituent filaments be made into staple fibers.

The number of twists in the present invention is determined by $31000/\sqrt{D'}$ (T/M) where T/M represents turns per meter, as a standard in which D' = (the total denier D of an undrawn yarn) $x$ (the draw ratio used). In particular, values of not more than about $31000/\sqrt{D'}$ are desirable. Usually, operation in accordance with this invention is carried out so that the number of twists is about $3100/\sqrt{D'} \div (0.7 \text{ to } 1.0)$. Further, this number of twists is applied as the number of rotations, of a spindle (r.p.m.)/the peripheral speed of the draw rolls (m.p.m. or meters/minute).

Description in greater detail will be made below with regard to the draw ratio used in this invention.

Figure 3:
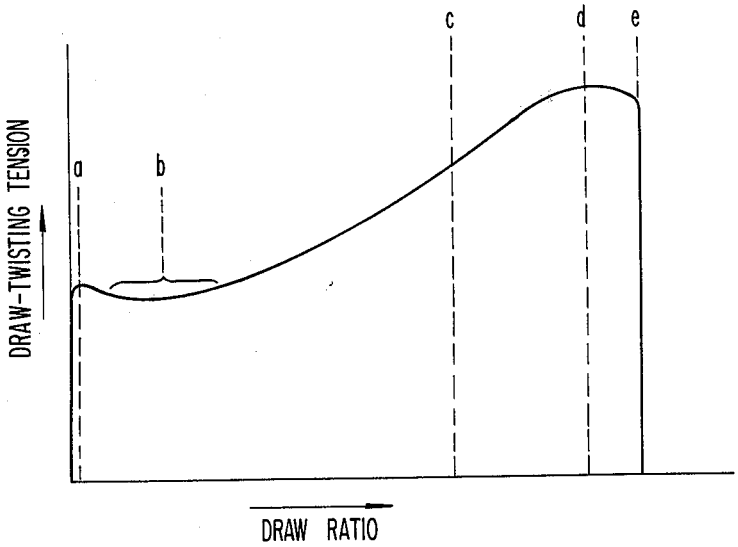
FIG. 3 is a diagram showing the relation between the draw ration and the draw-twisting tension.

FIG. 3 is a diagram showing the relation between the draw ratio and the draw-twisting tension (this expression is used since the yarn is substantially drawn within a twisting zone between the feed rolls and a false-twisting device) when the yarn is simultaneously subjected to drawing and twisting. It can be seen from this diagram that generally with increasing draw ratio, the draw-twisting tension slightly decreases past the yield point ($a$), and for a while, becomes substantially constant (natural drawing area ($b$)). After passing this area, the tension again increases and reaches the maximum point ($d$). When the tension reaches the broken draw ration ($e$), the entire yarn is broken. In the area between ($d$) and ($e$), the constituent filaments begin to break partially. Usually, the draw ratio is selected within the range where the breakage of the filaments does not occur, for example, in the area between ($c$) and ($d$) in FIG. 3.

In accordance with this invention the simultaneous drawing and false-twisting of an undrawn yarn are performed at a draw ratio within the range which substantially corresponds to the area between ($d$) and ($e$) in FIG. 3 with the number of twists adjusted to not more than about $31000/\sqrt{D'}$ (T/M). More specifically, the most suitable draw ratio is from about 0.88 to 0.98 times the broken draw ratio ($e$). If the draw ratio is greater than 1.0 times the broken draw ratio, the yarn tends to break during processing. If, on the other hand, the draw ratio is lower than about 0.88 times the broken draw ratio, the number of fluffs formed decreases.

The processing temperature which can be used in this invention is a temperature at which the false twists are heat-set. If the temperature is too high, non-detwisted portions remain in the yarn, and due to heat deterioration, the tenacity of the processed yarn is reduced markedly. Therefore, a processing temperature should be used so as to avoid these difficulties. The upper limit of the processing temperature differs according on the type of fibers or the degree of molecular orientation of the undrawn yarn, but is generally about 5°to 10°C lower than the optimum temperature within the range previously described for false-twisting drawn yarns.

By performing drawing and false-twisting at the same time as in the present invention, the filaments constituting the yarn simultaneously undergo a bending and twisting deformation and a stretching deformation, and therefore, tend to break. The individual filaments tend to break sporadically, presumably because the degree of deformation differs among the filaments. Accordingly, since the lengths of the broken filaments have a broad distribution ranging from several centimeters to several meters, and without any consequent breaking of the entire yarn, the individual filaments are broken partly to form fluffs. In this way, a spun-like yarn can be produced easily.

If only the drawing of an undrawn yarn is performed, the area (*d*) to (*e*) in FIG. 3 still exists. However, as compared with the present invention in which both the drawing and falsetwisting of the yarn are simultaneously performed, the area is extremely narrow, and can scarcely be utilized technically. When drawing and false-twisting are performed simultaneously in accordance with this invention, the area (*d*) to (*e*) is so wide that it can be utilized technically. Part of the constituent filaments of a drawn yarn could be broken only by drawing, to form fluffy broken ends. Generally, however, the number of such broken parts is extremely small, and they cannot produce a fluff effect. In addition, such fluffy parts cause difficulties by wrapping around draw rolls or other parts of the equipment during yarn passage. In contrast, when the yarn is simultaneously drawn and false-twisted in accordance with this invention, the frequency of filament breakage increases markedly, and since the resulting fluffs are crimped by the false-twisting treatment, no difficulties arise from a wrapping around of the rolls, for example.

In spite of the fact that the yarn of this invention is substantially non-twisted as a whole, the individual filaments are crimped and intertwined and at times S twists and Z twists exist alternately along the yarn, so that the filaments have some degree of coherency. Accordingly, the filaments which have become fluffy as a result of breaking do not fall off during running, nor pills are formed on press contact with a yarn guide, for example.

Since the present invention provides a method wherein filaments are positively broken by twisting and drawing, the number of fluffs formed is large, and the frequency of fluff occurrence is constant.

The apparatus which can be used in accordance with this invention has quite the same structure as a conventional false-twister, and the conventional false-twister can be advantageously used in this invention after only slightly modifying the power transmission system of the false-twister so that a high draft ratio corresponding to the draw ratio can be obtained between the feed rolls and the delivery rolls of the false-twister.

Furthermore, according to this invention, a false-twisted yarn can be produced directly from an undrawn yarn obtained by a filament-making process, and a conventional drawing step need not be separately provided. This, of course, contributes to a minimization of the cost of production.

Yarns of various feels and appearances can be produced by choosing the heating time and the heating temperature appropriately so as to change the temperature distribution of the filaments in the outer and inner layers of the yarn and, accordingly, the distribution of the flattened filament condition. Specifically, when the heater length is shortened to a great extent and the yarn is treated for a short period of time of, for example, 0.03 second, the outer layer of the yarn in the twisting zone is kept at an ultra-high temperature and the inner layer is at a relatively low temperature. Consequently, the state of flattening and the state of breaking vary complicatedly, andd yarns of different feels and appearances can be obtained. As regards the number of twists, twists which are about 10% smaller than in the case of producing false-twisted yarns are preferred.

The process of this invention will be further described by reference to the accompanying drawings.

In FIG. 1, an undrawn multifilament yarn 1 is fed through feed rolls 2, and is being crimped by passing through a first heating device 3 and a twisting device 5. At the same time, the yarn is drawn by draw rolls 6. The substantial drawing point exists at a point several centimeters from the entrance of the heater 3, and the individual filaments are twisted and their sectional areas flattened. The yarn which has passed through the twisting device 5 is converted to a spun-like yarn 7 with the individual filaments broken to staple fibers in the detwisting zone, and is withdrawn in the false-twisted or truly twisted state. It is desirable that the distance between the first heating device 3 and the twisting device 5 should be short so that the yarn is detwisted before being cooled. Since the distance between the twisting device 5 and the draw rolls 6 greatly affects the breaking of the filaments, it is recommended that this distance be variable or that a holding point be provided between the twisting device and the draw rolls to adjust the extent of breaking the filaments into staple fibers and the lengths of the fibers.

The undrawn yarn passes through the heating zone from the feed rolls 2 while being twisted by the twisting device 5. During passage, the individual filaments constituting the yarn appear in the surface layer of the yarn or are present in the inner part of the yarn, while passing in a helical form. The area appearing in the surface layer of one multifilament is greatly influenced by the heating, twisting and drawing and is greatly flattened as shown by hatched areas in FIG. 4. When the undrawn yarn is simultaneously heated, drawn and twisted, the degree of deformation of the filament varies among the central part *f*, the inner layer *g* and the surface layers *h* and *i*. FIG. 4 shows a cross-section of a yarn when a yarn comprising an undrawn yarn having circular cross-section is simultaneously drawn and false-twisted.

FIG. 5 shows the cross-sectional surface of an ordinary drawn yarn having a typical non-circular cross section. When such a yarn is false-twisted, the sectional surface does not change in shape very much as shown in FIG. 7. However, when the undrawn yarn shown in FIG. 5 is processed by the process of this invention, the cross-sectional surface of the yarn is flattened as shown in FIG. 6.

As described above, the present invention is based on the discovery that a yarn like a spun yarn is obtained from an undrawn yarn by a very simple single processing. Since the yarn is twisted by a false-twisting method, the productivity is very high. Unlike the production of spun yarns using conventional techniques, the twisting and winding by a ring traveller is not altogether required, and therefore, a large package of knotless yarn can be freely obtained. Thus, the process lends itself to high efficiency.

Heating for drawing, crimping and breaking can be performed using only one heating zone, and this renders the process very efficient.

Figure 2:
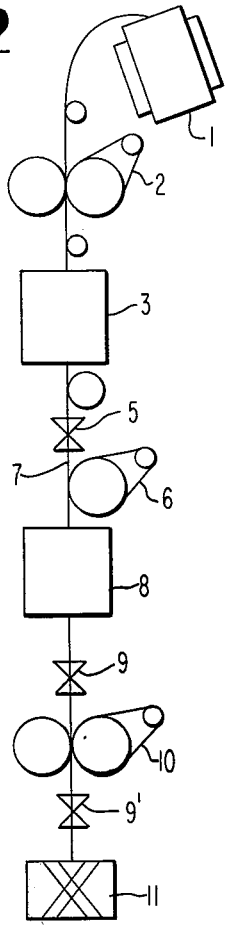

The yarn obtained by the process of this invention described above has sufficient serviceability, and can be used for producing woven or knitted fabrics either as such or after further being subjected to twisting, doubling, plying or heat-treatment, etc. In order to improve the feel and quality of the yarn further, a second heating device 8, a twisting device 9 and take-up rolls 10 are provided after the draw rolls 6 as shown in FIG. 2, and the resulting yarn is further subjected to treatment on these devices. When a yarn broken into a staple form is heat-treated under relaxation, the crimps are stretched out, and the dimensional stability of the fibers to heat improves. On the other hand, however, the coherency of the fibers due to the crimps is reduced. In order to render the yarn coherent, a turbulent effect is given to the yarn using an ultrahigh speed hollow tubular false-twisting device (the use of a twist-setting pin can be omitted) or a jet vortex flow. This is intended to develop the broken ends of the filaments in the yarn as fluffs using a centrifugal force, electrostatically, or using air streams occurring at the time of twisting. It is necessary that the heat-treatment and the application of a filament disturbing action should be performed under relaxation. Substantially the same effects can be obtained even when heat-treatment under relaxation is performed between the draw rolls 6 and the take-up rolls 10, and the disturbing of the filaments is effected at the position 9' instead of the false-twisting device 9. The yarn can also be treated by providing a device for applying a bundling agent such as pastes, oils or waxes between the draw rolls 6 and the take-up rolls 10. By employing the post-treatment step, the degree of crimp can be adjusted according to the feel desired, and a wide variety of yarns ranging from a yarn having high stretchability to a yarn having good dimensional stability can be obtained. When the yarn 7 is false-twisted by this process, the coherency among the staple fibers greatly increases, and the resulting yarn has high strength.

The yarns obtained by the process described above are somewhat different from spun yarns obtained using conventional techniques. The individual constituent filaments contained in the yarn of this invention are crimped in the twisted state by virtue of false-twisting, and the cross-sectional areas of the filaments have a markedly flattened portion. The breaking of filaments occurs mainly at those portions which are flattened to a lesser degree. The flattening of the cross-sectional surfaces of the filaments contributes to an improvement in feel, appearance and bulkiness of the yarn and the coherency of the constituent fibers. Furthermore, these filaments are characterized in that they as a whole form the surface layer and the inner layer of the yarn alternately, and are intertwined in a truly twisted condition or in the substantially non-twisted state with the broken ends of the filaments forming fluffs. The form of the side of this yarn is shown in FIG. 13.

In addition to the above-described structural and formal characteristics, the yarn obtained by the method and apparatus shown in FIG. 2 is characterized in that the broken ends of the filaments are mixed uniformly throughout the surface layer and inner layer of the yarn. The optimum conditions for breaking the yarn of this invention into staple fibers will vary according to the properties or type of the undrawn yarn. In this invention, the main factors determining the conditions for staple fiber formation are the temperature of the heater, the number of false-twists, and the draw ratio. Generally, it is the practice to experimentally measure the number of fluffs formed as a result of breaking with regard to these variable factors, and then select those conditions that would most frequently yield broken fluffs.

This will be specifically described with regard to some typical fibers.

Figure 8:
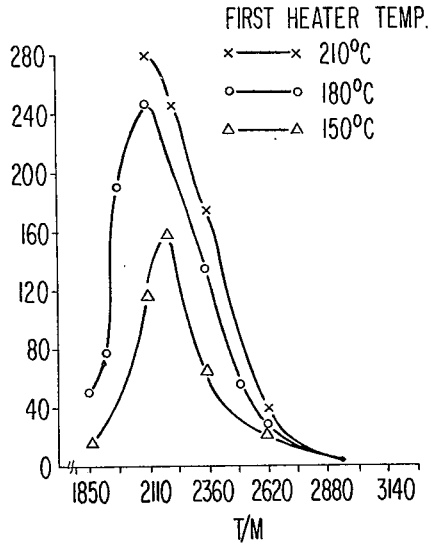
FIGS. 8 to 11 show the relations between the treated yarns and the treating conditions.
Figure 9:
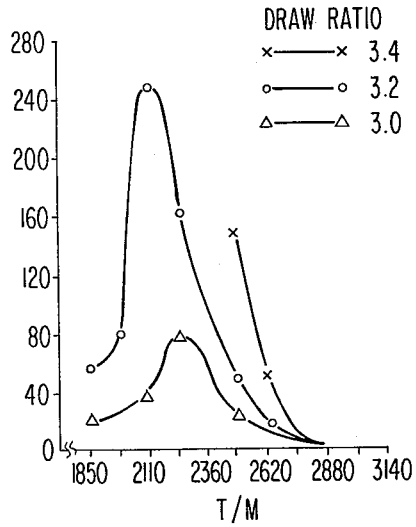
Figure 10:
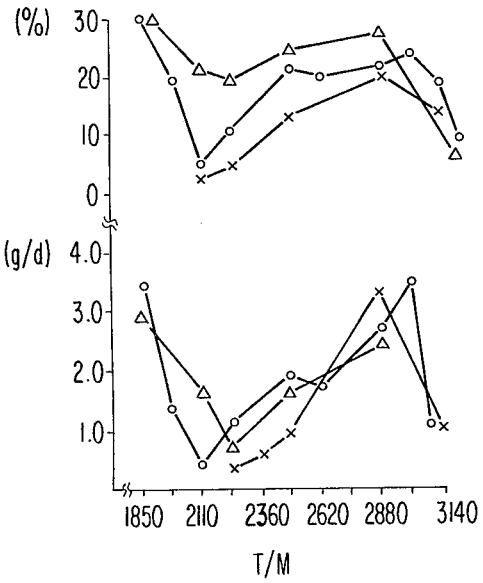
Figure 11:
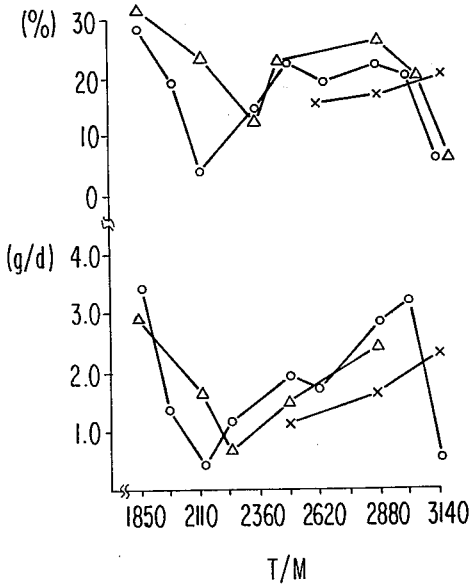

First, the optimum conditions for obtaining the yarn of this invention using an undrawn yarn (480 denier/72 filaments) of polyethylene terephthalate having a maximum draw ratio of 3.2 on an apparatus of the type shown in FIG. 1 will be described. These conditions are shown in FIGS. 8 to 11. FIG. 8 shows the relation between the number of twists and the number of fluffs in the resulting yarn with the temperature of the first heater (heating device 3 is FIG. 1) being maintained constant. FIG. 9 shows the relation between the number of twists and the number of fluffs in the resulting yarn with the draw ratio being maintained constant. FIG. 10 shows the relation between the number of twists and the tenacity and elongation of the resulting yarn with the temperature of the first heater being maintained constant as in FIG. 8. FIG. 11 shows the relation between the number of twists and the tenacity and elongation of the resulting yarn with the draw ratio being maintained constant as in FIG. 9.

Next, the optimum conditions for obtaining the yarn of this invention using an undrawn yarn (400 denier/72 filaments) of nylon 6 (residual elongation 300%, birefringence $29 \times 10^{-3}$) on an apparatus of the type shown in FIG. 1 will be described. In the case of nylon 6, it is necessary to preheat the yarn with feed rolls 2 heated to at least 80° to 160°C or using other means, and also to subject the yarn to a pre-treatment such as a treatment with water. Instead of heating the rolls 2, a fixed pin capable of being heated may be provided between the rolls 2 and the heater 3. The number of fluffs formed in relation to the temperature of the heater, the number of twists and the draw ratio and the temperature curve are similar to those for polyethylene terephthalate yarns. The optimum staple fiber forming conditions for the undrawn yarn of nylon 6 are: a temperature for the feed rolls 2 of 100° to 150°C; a temperature of the heater 3 of 180° C; the number of twists of 2200 T/M; and a draw ratio of 2.8.

The following Examples illustrate the present invention in greater detail. These Examples were operated under these conditions that would give the maximum value on the draft-fluff curve experimentally obtained in advance as shown in FIGS. 8 and 9.

In the examples the number of fluffs was determined visually and is an average of 20 examinations.

In the following examples the intrinsic viscosity was measured as a solution of the polymer in a 1:1 by weight mixed solvent of phenol and tetrachloroethane at 20°C for polymers except polyamides which were measured in 96% by weight sulfuric acid at 30°C.

EXAMPLE 1

Polyethylene terephthalate having an intrinsic viscosity of 0.70 was spun using a spinneret having 48 nozzle holes each with a diameter of 0.3 mm at a temperature of 285°C at a polymer out put rate of 68 g/min, and wound up at a rate of 1200 m/min to form an undrawn yarn (510 denier/48 filaments) having a birefringence ($\Delta n$) of $7.5 \times 10^{-3}$. The resulting undrawn yarn was simultaneously drawn and false-twisted using a false-twister (Model ST-5, the product of Mitsubishi Heavy Industries, Japan). This false-twister was modified so that the speed of the feed rolls was decreased to obtain a high draw ratio between the feed rolls and the delivery rolls.

The processing conditions and the properties of the yarns obtained are shown in Table 1 below. In Runs Nos. 1 to 4, the draw ratio was changed with the number of twists and the processing temperature being maintained constant. The broken draw ratio was 3.53 when the processing conditions in Runs Nos. 1 to 4 were employed. The yarns obtained in these Runs had fluffs very similar to those of spun yarns.

In Run No. 5, the number of twists was smaller than those in Runs Nos. 1 to 4. In this case, the broken draw ratio was 3.47.

Table 1

| | Run No. 1 | 2 | 3 | 4 | 5 | 6 | 7 |
|---|---|---|---|---|---|---|---|
| Spindle Speed (rpm) | 20×10⁴ | 20×10⁴ | 20×10⁴ | 20×10⁴ | 17.5×10⁴ | 17.5×10⁴ | 22.5×10⁴ |
| Number of Twists (T/M) | 2300 | 2300 | 2300 | 2300 | 2110 | 2110 | 2550 |
| Processing Temperature (°C) | 185 | 185 | 185 | 185 | 185 | 185 | 185 |
| Draw Ratio | 3.20 | 3.30 | 3.40 | 3.53 | 3.20 | 3.47 | 3.20 |
| Denier of Yarn | 160 | 154 | 150 | — | 161 | — | 160 |
| Number of Fluffs Formed per 10 cm | 8.1 | 22.5 | 58.9 | Entire yarn was broken, and processing was impossible | 20.4 | Entire yarn was broken, and processing was impossible | 0.2 |
| Tenacity of Yarn (g) | 320 | 270 | 224 | | 325 | | 495 |

It can be seen from a comparison of Run No. 5 with Run No. 1 that with a decreasing number of twists, the number of fluffs tends to increase. When the number of twists is increased as in Run No. 7, the number of fluffs gradually decreases.

EXAMPLE 2

The yarn obtained in Run No. 3 in Example 1 was further twisted using a ring twister in the same direction as the direction of false-twisting. The number of twists and the results obtained are shown in Table 2 below.

Table 2

| | Run No. 8 | 9 | 10 | 11 |
|---|---|---|---|---|
| Number of Additional Twists (T/M) | 50 | 150 | 300 | 600 |
| Number of Fluffs Formed per 10 cm | 58.0 | 58.5 | 60.5 | 61.3 |
| Tenacity of the Additionally Twisted Yarn (g) | 270 | 345 | 391 | 475 |

The additionally twisted yarns obtained in Runs Nos. 8 to 11 had increased tenacity, and snarling was relatively rare. The releasability of the yarn from the cone was good, and the yarns exhibited good workability in knitting.

EXAMPLE 3

Two yarns obtained in Run No. 3 were co-twisted using a ring twister. The number of twists and the results obtained are shown in Table 3.

Table 3

| | Run No. 12 | 13 | 14 | 15 |
|---|---|---|---|---|
| Direction of False-Twisting | Z and Z | Z and Z | S and Z | S and Z |
| Direction of Co-twisting | Z | Z | Z | Z |
| Number of Co-twists (T/M) | 150 | 400 | 100 | 300 |
| Number of Fluffs Formed per 10 cm | 46.0 | 47.5 | 47.8 | 48.5 |
| Tenacity of the Co-twisted Yarn (g) | 700 | 940 | 645 | 870 |

The yarns obtained in Runs Nos. 12 to 15 all had a tactile hand similar to that of spun woolen yarns, and also had stretchability and bulkiness properties similar to those of false-twisted yarns. As a result of co-twisting, the tenacity of the yarn was increased, and the workability of the yarn was good in knitting or weaving.

EXAMPLE 4

An undrawn yarn (150 denier/48 filaments'drawn yarn) of polyethylene terephthalate (intrinsic viscosity 0.45) was drawn and twisted simultaneously at a draw ratio of 3.2 with the number of twists being 2300 T/M. The first and second heaters were maintained at 190°C. A yarn like a spun yarn having more fluffs than when using the undrawn yarn of polyethylene terephthalate having an intrinsic viscosity of 0.7 (Example 1) was obtained, as shown in Run No. 16 in Table 4.

EXAMPLE 5

Two undrawn yarns (each for 70 denier/24 filaments' drawn yarn) of nylon 6 having an intrinsic viscosity of 1.0 were aligned and preheated by being wound once around a hot pin maintained at 100°C. Subsequently, the yarns were drawn and false-twisted at a draw ratio of 3.2 with the number of twists being 2447 T/M. The first heater was maintained at 180°C, and the second heater was maintained at 190°C. A spun yarn-like yarn having many fluffs was obtained, as shown in Run No. 17 in Table 4.

EXAMPLE 6

Two undrawn yarns (each for 70 dener/36 filaments' drawn yearn) of polyether ester (poly-p-ethyleneoxybenzoate) having an intrinsic viscosity of 0.69 were aligned, and drawn and false-twisted at a draw ratio of 2.6 with the number of twists being 2450 T/M. The first and second heaters were maintained at 190°C. A spun yarn-like yarn having many fluffs as shown in Run No. 18 in Table 4 was obtained.

Table 4

| Runs Nos. | Fineness (denier) | Tenacity (grams) | Elongation (%) | Number of Fluffs per 10 cm |
|---|---|---|---|---|
| 16 (Example 4) | 167.0 | 141.8 | 13.7 | 70 |
| 17 (Example 5) | 135.0 | 330.6 | 28.2 | 25 |
| 18 (Example 6) | 156.0 | 123.0 | 15.0 | 40 |

While the invention has been described in detail and with reference to specific embodiments thereof, it will be apparent to one skilled in the art that various changes and modifications can be made therein without departing from the spirit and scope thereof.

What is claimed is:

1. A yarn comprising thermoplastic synthetic staple fibers in which the individual fibers constituting the yarn contain twisted crimps and have cross-sectional surfaces with a markedly flattened portion, in which the staple fibers contained therein have broken ends comprising mainly portions flattened to a lesser degree, a plurality of fibers having this structure uniformly and alternately forming the surface and inner layers of the yarn and being intertwined at fluffs formed of the broken ends of the individual fibers.

2. The yarn of claim 1, wherein the staple fibers have a length of about 10 mm to 400 mm.

3. The yarn of claim 1, wherein the degree of flattening of the markedly flattened portion is from about 1:2 to 1:7 in terms of the ratio of short diameter to long diameter of the cross sectional area and the degree of flattening of lesser flattened portion of the broken ends is from 1:1 to 1:2.

4. The yarn of claim 1, which contains about 50 to 500 fluffs per meter.

5. The yarn of claim 1, wherein each of the constituent fibers has a fineness of about 1.0 to 6.0 denier, with the deniers of these constituent fibers being the same.

6. A process for producing a yarn which comprises drawing an undrawn yarn comprising multifilaments of a thermoplastic synthetic polymer and having substantially the same break elongation, in a twisted state at an elevated temperature thereby to remarkably flatten portions of the individual filaments which appear on the outer layer of the yarn, and immediately detwisting the yarn to break at least a part of those portions of said filaments which are flattened to a lesser degree, followed by taking up the yarn.

7. The process of claim 6, wherein said thermoplastic synthetic polymer is a polyester having an intrinsic viscosity of about 0.4 to 1.3, as measured as a solution in a 1:1 by weight mixed solvent of phenol and tetrachloroethane at 20°C.

8. The process of claim 7, wherein the polyester has an intrinsic viscosity of about 0.4 to 0.8.

9. The process of claim 6, wherein said thermoplastic synthetic polymer is a polyether ester having an intrinsic viscosity of about 0.5 to 0.7, as measured as a solution in a 1:1 by weight mixed solvent of phenol and tetrachloroethane at 20°C.

10. The process of claim 6, wherein said thermoplastic synthetic polymer is a polyamide having an intrinsic viscosity of about 0.9 to 2.1, as measured as a solution in 96% sulfuric acid at 30°C.

11. The process of claim 10, wherein said polyamide has an intrinsic viscosity of about 0.9 to 1:1.

12. The process of claim 6, wherein said thermoplastic synthetic fibers are polyester fibers having a birefringence of about $5 \times 10^{-3}$ to $40 \times 10^{-3}$.

13. The process of claim 6, wherein said thermoplastic synthetic fibers are polyether ester fibers having a birefringence of about $2 \times 10^{-3}$ to $35 \times 10^{-3}$.

14. The process of claim 6, wherein said thermoplastic synthetic fibers are polyamide fibers having a birefringence of about $20 \times 10^{-3}$ to $40 \times 10^{-3}$.

15. The process of claim 12, wherein said polyester fibers have a birefringence of about $5 \times 10^{-3}$ to $20 \times 10^{-3}$.

16. The process of claim 13, wherein said polyether ester fibers have a birefringence of about $2 \times 10^{-3}$ to $18 \times 10^{-3}$.

17. The process of claim 14, wherein said polyamide fibers have a birefringence of about $20 \times 10^{-3}$ to $29 \times {}^{-3}$.

18. The process of claim 6, wherein each of the constituent multifilaments has a break elongation of at least about 120%.

19. The process of claim 6, wherein said undrawn yarn comprises at least 24 multifilaments.

20. The process of claim 6, wherein the shape of the cross-sectional area of the yarn is circular, non-circular, hollow or a combination thereof.

21. The process of claim 6, wherein the temperature is below the softening point of the synthetic filaments but above a temperature equal to 2/3 of the softening point.

22. The process of claim 6, wherein drawing is carried out at a draw ratio which is about 0.8 to 1.1 times the broken draw ratio of said thermoplastic synthetic yarn.

23. The process of claim 22, wherein the draw ratio is about 0.88 to 0.98 times the broken draw ratio of said thermoplastic synthetic yarn.

24. The process of claim 6, wherein the false-twisting is performed using a spindle method.

25. The process of claim 6, wherein the twisting is carried out with the number of twists being not more than $31000/\sqrt{D'}$ (T/M) in which D' is the product of the denier of the undrawn multifilament yarn divided by the draw ratio and T/M represents the number of turns per meter.

26. The process of claim 6, wherein said thermoplastic synthetic fibers are nylon 6 fibers, and before heating, the nylon 6 fibers are pre-heated to a temperature of about 80°to 150°C.

27. The process of claim 6, wherein said thermoplastic synthetic fibers are nylon 6 fibers, and before being subjected to the drawing and false-twisting operation, the nylon 6 fibers are treated with water.

28. A yarn comprising thermoplastic synthetic staple fibers and continuous filaments in which the individual fibers constituting the yarn contain twisted crimps and have cross-sectional surfaces with a markedly flattened portion, in which the staple fibers contained therein have broken ends comprising mainly portions flattened to a lesser degree, a plurality of fibers having this structure uniformly and alternately forming the surface and inner layers of the yarn and being intertwined at fluffs formed of the broken ends of the individual fibers.

29. The yarn of claim 1, wherein said thermoplastic synthetic staple fibers are selected from the group consisting of polyesters, polyamides and polyacrylonitriles.

30. The yarn of claim 28, wherein said thermoplastic synthetic staple fibers and continuous filaments are selected from the group consisting of polyesters, polyamides and polyacrylonitriles.

31. The yarn of claim 28, wherein the staple fibers have a length of about 10 mm to 400 mm.

32. The yarn of claim 28, wherein the degree of flattening of the markedly flattened portion is formed about 1:2 to 1:7 in terms of the ratio of short diameter to long diameter of the cross-sectional area and the degree of flattening of lesser flattened portion of the broken ends is from 1:1 to 1:2.

33. The yarn of claim 28, which contains about 50 to 500 fluffs per meter.

34. The yarn of claim 28, wherein each of the constituent fibers has a fineness of about 1.0 to 6.0 denier, with the deniers of these constituent fibers being the same.

35. The process of claim 6, wherein the false-twisting is performed using a friction method.

36. The process of claim 6, wherein said thermoplastic synthetic fibers are nylon 6 fibers, and before being subjected to the drawing and false-twisting operation, the nylon 6 fibers are treated with a textile oil.

37. A process for producing a yarn which comprises breaking at least a part of an undrawn yarn of multifilaments of a thermoplastic synthetic polymer which have substantially the same break elongation by means of heating, drawing and false-twisting the yarn at the same time to form a yarn containing staple fibers, and applying to the yarn a means for improving its heat stability, followed by taking up the yarn.

38. A process for producing a yarn which comprises breaking at least a part of an undrawn yarn of multifilaments of a thermoplastic synthetic polymer which have substantially the same break elongation by means of heating, drawing and false-twisting the yarn at the same time to form a yarn containing crimped staple fibers, and applying to the yarn a means for improving its coherency, followed by taking up the yarn.

39. The process of claim 37, wherein said yarn is a polyester, a polyamide or a polyacrylonitrile yarn.

40. The process of claim 38, wherein said yarn is a polyester, a polyamide or a polyacrylonitrile yarn.

41. The process of claim 37, wherein said means for improving the heat stability of the yarn is heating.

42. A process for producing a yarn which comprises breaking at least a part of an undrawn yarn of multifilaments of a thermoplastic synthetic polymer which have substantially the same break elongation by means of heating, drawing and false-twisting the yarn at the same time to form a yarn containing crimped staple fibers, and false-twisting the yarn to improve its coherency, followed by taking up the yarn.

43. A process for producing a yarn which comprises breaking at least a part of an undrawn yarn of multifilaments of a thermoplastic synthetic polymer which have substantially the same break elongation by means of heating, drawing and false-twisting the yarn at the same time to form a yarn containing crimped staple fibers, and true-twisting the yarn to improve its coherency, followed by taking up the yarn.

44. A process for producing a yarn which comprises breaking at least a part of an undrawn yarn of multifilaments of a thermoplastic synthetic polymer which have substantially the same break elongation by means of heating, drawing and false-twisting the yarn at the same time to form a yarn containing crimped staple fibers, and subjecting the yarn to a fluid jet to improve its coherency, followed by taking up the yarn.

45. A process for producing a yarn which comprises breaking at least a part of an undrawn yarn of multifilaments of a thermoplastic synthetic polymer which have substantially the same break elongation by means of a heating, drawing and false-twisting the yarn at the same time to form a yarn containing crimped staple fibers, and applying a bundling agent to the yarn to improve its coherency, followed by taking up the yarn.

* * * * *